United States Patent [19]

Raetz

[11] 4,010,621

[45] Mar. 8, 1977

[54] STIRLING CYCLE HEAT PUMP

[76] Inventor: Karlheinz Raetz, No. 12, Gassnerstrasse, 33 Braunschweig, Germany

[22] Filed: Dec. 30, 1974

[21] Appl. No.: 537,530

[30] Foreign Application Priority Data

Jan. 4, 1974 Germany ..... 2400256
Nov. 8, 1974 Germany ..... 2452986

[52] U.S. Cl. ..... 62/6
[51] Int. Cl.² ..... F25B 9/00
[58] Field of Search ..... 60/516, 517, 526, 546; 62/6; 165/10

[56] References Cited

UNITED STATES PATENTS

| | | | |
|---|---|---|---|
| 1,808,921 | 6/1931 | Frankl | 165/10 |
| 2,368,101 | 1/1945 | Bottcher | 62/142 |
| 2,611,236 | 9/1952 | Kohler | 60/526 |
| 3,530,681 | 9/1970 | Dehne | 62/6 |
| 3,604,821 | 9/1971 | Martini | 62/6 |
| 3,788,088 | 1/1974 | Dehne | 62/6 |
| 3,827,675 | 8/1974 | Schuman | 60/517 |
| 3,862,546 | 1/1975 | Daniels | 62/6 |

*Primary Examiner*—Lloyd L. King
*Attorney, Agent, or Firm*—John C. Smith, Jr.

[57] ABSTRACT

A heat pump which is based on the principle of the Stirling engine and in which the pistons are replaced by flexible metal bellows. The pumping chamber is embraced by a regenerator of corrugated metal ribbon construction and enclosed in a pressure-tight vessel.

12 Claims, 5 Drawing Figures

FIG.4
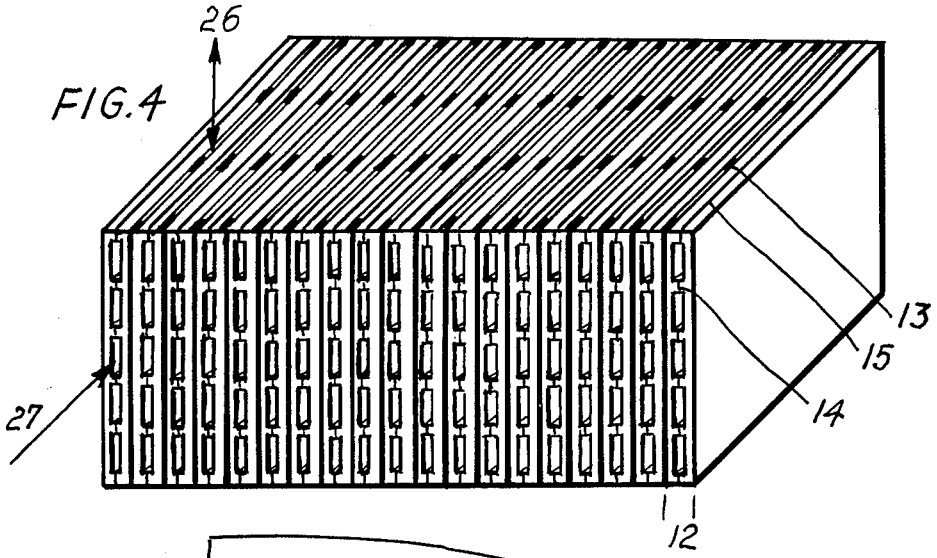
FIG.5
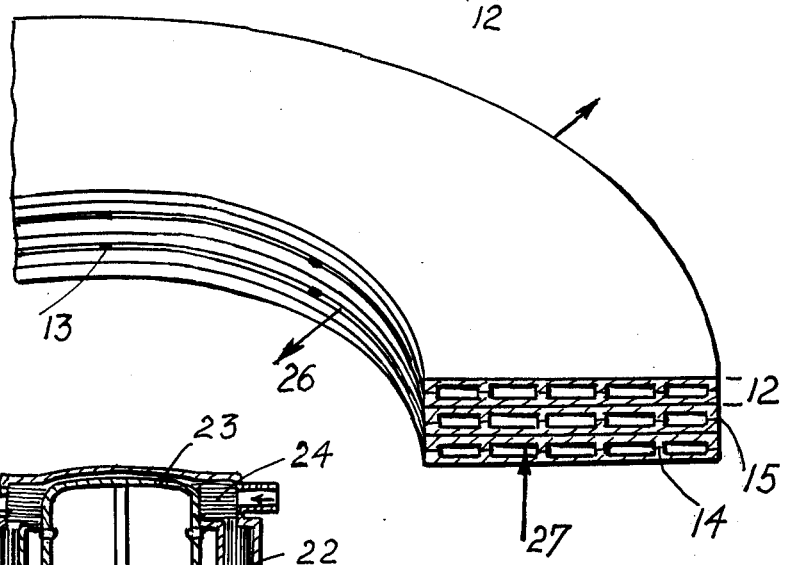
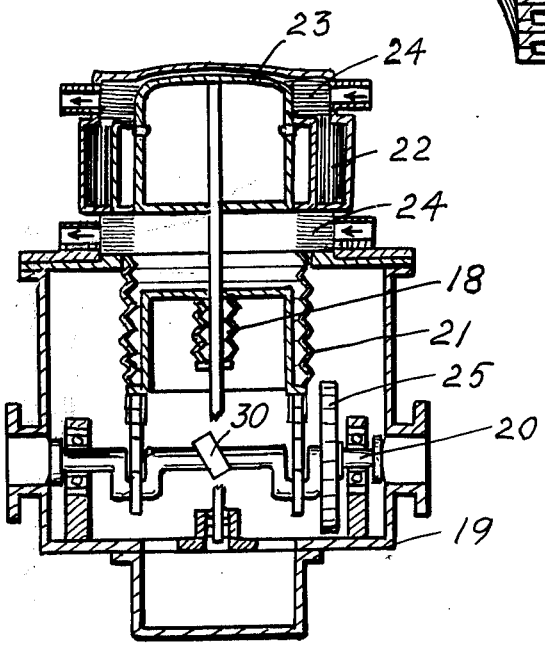
FIG.2

STIRLING CYCLE HEAT PUMP

BACKGROUND OF THE INVENTION

This invention relates generally to heat pumps. More particularly the invention relates to heat pumps which are based on the principle of Stirling's air engine and intended to work in the temperature interval from −30° to +100° C.

Heat pumps are advantageously used where heat has to be transferred from one temperature level to another higher temperature level.

Heat pumps based on the vapor compression cycle are well known in the art. In these pumps energy losses occur as a result of irreversible processes which reduce their coefficient of performance. Commercial heat pumps may have coefficients of performance of between 2.3 and 2.5 when transferring heat from a temperature of 0° C to a temperature between 32° and 35° C. The theoretical value for their coefficient of performance would be 9.

Apart from this poor coefficient of performance conventional heat pumps have the drawback that the temperature of the heat source has a lower limit of say −5° C in air-to-air heat pumps. Another objection is that the working media are environmental pollutants and that in operation the pumps generate considerable noise.

In the art of the liquefaction of gases, particularly the liquefaction of air, a known type of refrigerating machine is that based on Stirling's principle of operation. Such machines have not as yet been rendered suitable for use as heat pumps because irreversible losses due to friction between the pistons and the cylinder walls and to the resistance to gas flow through the regenerator are insupportably high.

The performance of a heat pump can be calculated from the following formula $$\dot{Q} = \dot{n} \cdot R \cdot T \cdot \log_e \frac{V_2}{V_1}$$

where $\dot{Q}$ is the heat rejected in watts, $\dot{n}$ is the recirculated volume of gas in mols per second, $R$ is the gas constant ($R = 8.31$ wattsecs/g.mol), $T$ is the heating temperature level in °K and $V_2/V_1$ is the compression ratio by volume which may here be assumed to be 2.

It will therefore be understood that the thermal output depends upon $\dot{n}$. A large volume of gas $n$ means a large cylinder volume or a smaller volume at higher gas pressure. Moreover, the thermal output can also be improved by raising the frequency of piston reciprocation.

Conventional gas liquefaction plants operate with a small volume of gas at higher pressure and high frequencies of piston reciprocation. This is not practicable for a Stirling type heat pump because the heat exchangers required for a domestic air conditioning system would call foor a very large working volume. Naturally large heat pumps would have large pistons and the frictional losses would be correspondingly high.

SUMMARY OF THE INVENTION

The general object of the present invention is the provision of a Stirling heat pump which will permit these shortcomings to be overcome.

More particularly it is an object of the invention to provide a Stirling cycle heat pump which contains vacuum-tight, oil-free, non-friction pistons and cylinders.

Another object of the invention is the provision of a Stirling cycle heat pump capable of handling large volumes as well as high pressures.

Yet another object of the invention is the provision of a Stirling cycle heat pump which can operate with hydrogen or helium as the working medium.

In order to minimise adiabatic and dynamic losses it is an object of the invention to provide a Stirling cycle heat pump which can operate at a low pumping frequency.

Moreover, a further object of the invention is the provision of a Stirling cycle heat pump in which the regenerator has a high heat storage capacity and the parasitic space is a minimum.

A final object of the invention is to provide a Stirling cycle heat pump comprising a heat exchanger having a high heat transfer coefficient and the least possible parasitic space.

Substantially for achieving these objects the invention proposes a heat pump based on the Stirling cycle in which the pumping chamber is formed by a flexible metal bellows of welded construction associated with a regenerator and heat exchanger.

The advantages afforded by the replacement of pistons by bellows can be summarised by saying that large pumping volumes at high gas pressures can be provided, that metal bellows can be made vacuum-tight and therefore permit the use of hydrogen or helium as a working medium, that the piston creates no frictional losses, that the additional work needed to compress the metal bellows when compressing the gas is recovered during the expansion stroke and that metal bellows can be made of alloys which have no hysteresis effects.

Although welded metal bellows can now be manufactured with narrow width folds the dead space between the folds is not negligible and causes adiabatic losses when the gas is being compressed. These losses cannot be obviated by ordinary insulation because the warm air is expelled from the external folds of the metal bellows to the outside during compression and replaced by cold ambient air during expansion. The metal bellows is therefore preferably embraced by an annularly disposed regenerator in which the air displaced from between the folds gives up its heat during compression and the re-entering air recovers this heat during expansion.

When the bellows have diameters exceeding 30 cms the dead space may amount to as much as 10 percent of the total volume displaced during the compression stroke.

BRIEF DESCRIPTION OF DRAWING

In order that the nature of the invention may be more readily understood reference will be made to the drawing in which FIG. 2 is a modified form of construction of the heat pump, FIG. 4 is a preferred form of construction of a heat exchanger comprised of the heat pump, and FIG. 5 is a modification of such a heat exchanger.

BRIEF DESCRIPTION OF PREFERRED EMBODIMENTS

Figure 1:
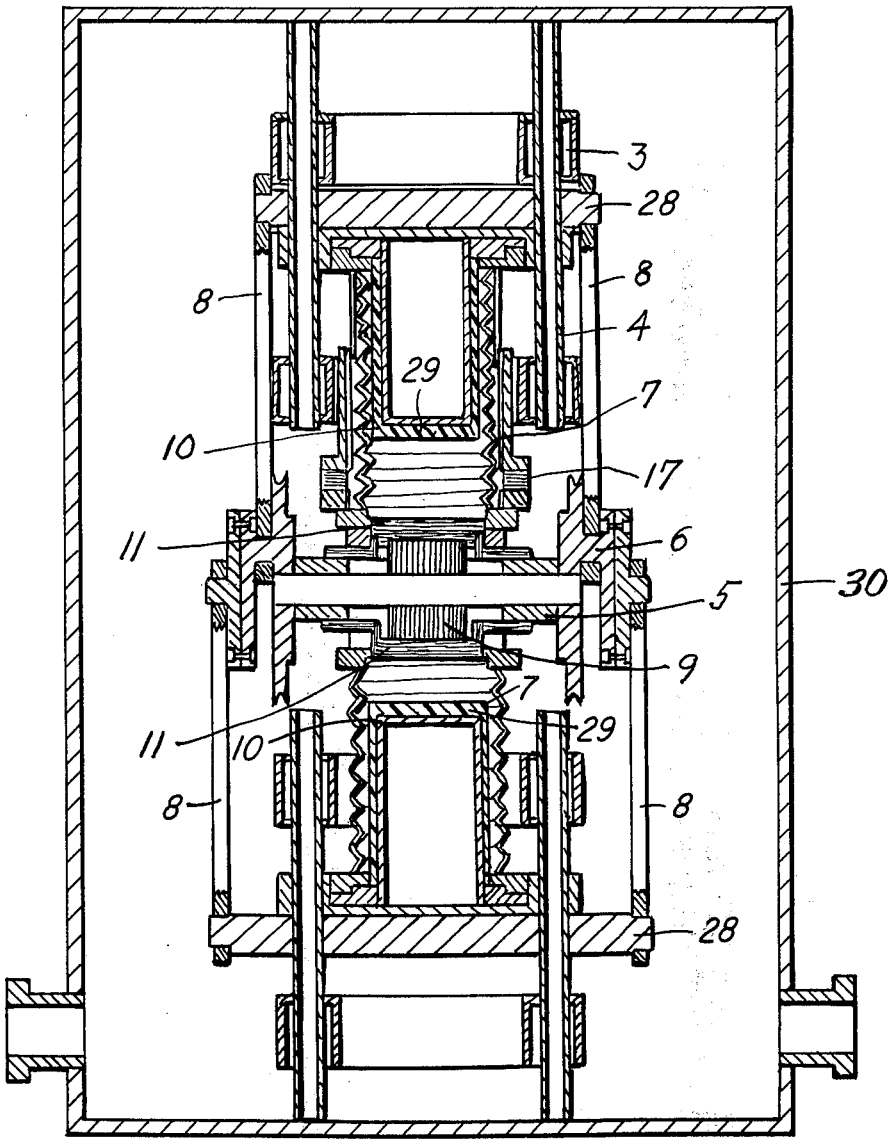
FIG. 1 is a diagrammatic representation in section of a Stirling cycle heat pump according to the invention.

Referring to FIG. 1 of the drawing, the illustrated heat pump according to the invention comprises a bearing plate 5 provided with bearings for a drive shaft which at each end carries a double crank 6. One pair of connecting rods 8 is attached to a cross beam 28 at the upper end of the pump, whereas the other pair of connecting rods drives a similar cross beam 28 at the lower end of the pump. Each cross beam is fitted with a pair of columns or guide rods for which are reciprocably guided in fixed ball bearing sleeves 3. A metal bellows 7 of welded construction extends between each cross beam and the bearing plate 5 in the centre. When the drive shaft rotates the hot end bellows 7 at the top and the cold end bellows 71 at the bottom expand and contract in a harmonic cycle with a relative displacement in phase of about 90°. Possibly the cranks may be replaced by cams.

In order to reduce the dead space a pot-shaped metal displacer 10 projects from each cross beam into the interior of the bellows. The displacer is preferably encased in a plastics sheath 29 for the protection of the bellows wall. The hot end bellows 7 is embraced by a regenerator 17 which serves the above described purpose. Facing the inner stationary end of the bellows is a heat exchanger 11 and a further regenerator 9. These are offset from the median centre plane of the pump and accommodated in front of and behind the drive shaft.

With advantage the heat pump may be enclosed in a high pressure vessel 30. This applies a balancing pressure to the two pistons reducing the load on the crankshaft. At the same time the internal pressure in the pumping chamber can be increased. The thermal output of a pump can thus be raised to a multiple of that attainable at ordinary pressures. Let it be assumed that the metal bellows wil withstand a pressure differential of up to 8 kg/cm². Then as shown in the following Table listing the operating data of two such pumps of which that on the left operating in an external pressure equal to atmospheric is filled to a pressure of 4 kg/cm² if the gas is to be compressed to 8 kg/cm², whereas the pump on the right can work between 16 and 32 kg/cm² in an external gas pressure of 24 kg/cm², the thermal output of the pump on the right under otherwise identical conditions is four times as great as that of the pump on the left.

TABLE

| Pump I | Pump II |
|---|---|
| $p_{min}$ 4 kg/cm² | $p_{min}$ 16 kg/cm² |
| $p_{max}$ 8 kg/cm² | $p_{max}$ 32 kg/cm² |
| $p_{external}$ atmospheric | $p_{external}$ 24 kg/cm² |
| speed of reciprocation 120/min | speed of reciprocation 120/min |
| heat output at 40° C 2000 watts. | heat output at 40° C 8000 watts. |

A different preferred embodiment of the invention is shown in FIG. 2. In this drawing 22 is the regenerator, 24 is the heat exchanger, 21 is the metal bellows, 23 is the displacer and 25 are coupling gear wheels. 20 is one of the crankshafts; the other being obscured in the drawing. 19 is an external pressure vessel and 18 is the push rod for operating the displacer and associated seal. This pump differs from that shown in FIG. 1 by the provision of only one bellow which is required to perform only a half stroke for the same change in volume because the displacement is effected by the displacer 23. Moreover, the provision of a cam plate 30 for operating the push rod of the displacer permits the ideal Stirling cycle to be approximated.

Figure 3:
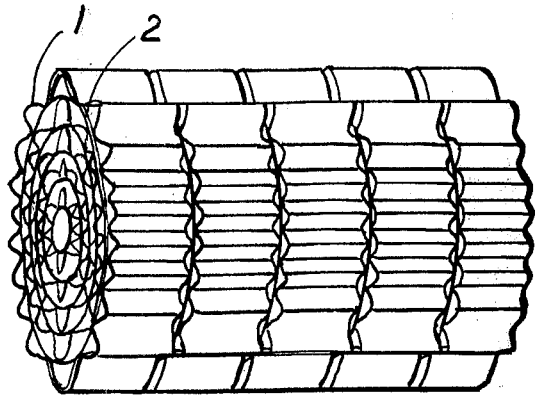
FIG. 3 is a schemtic representation of the preferred construction of a regenerator.

The regenerators used in Stirling engines usually consist of fine wires compressed into the form of a sponge. However, such regenerators are unsuitable for use in heat pumps because of the high resistance they offer to the passage of the gas, and their comparatively low specific heat storage capacity. According to the invention the regenerator is therefore made of metal foil as illustrated in FIG. 3. A crinkled or corrugated 1 ribbon of metal foil is rolled up together with a interleaved smooth ribbon 2 of foil. The gas can then stream through the interstices between the two ribbons.

A preferred form of construction of the heat exchanger is illustratively shown in FIG. 4. The design of this heat exchanger is based on the cross flow principle. The channels in a heat exchanging element 12 for the heat supplying water are formed between two plates connected at both ends by weld seams 15 and spaced apart by projecting transversely spaced abutting ribs 14 which also support the external pressure, whereas the crossing channels 26 for the working gas are formed by gaps between the heat exchanger elements 12 which are similarly held apart by strip-shaped spacers 13, shown in black in the drawing.

An alternative arrangement for a heat exchanger according to FIG. 4 is illustrated in FIG. 5. In this latter arrangement the working gas flows in the radial direction, whereas the heat transferring water flows through circular channels as indicated by the arrow 27. This is as arrangement which commends itself particularly for an embodiment of a heat pump according to FIG. 2.

I claim:

1. A heat pump which is operationally based on the Stirling cycle and which comprises:

a. a heat regenerator, b. two heat exchangers for circulating a heat transferring liquid and disposed adjacent to opposite sides respectively of and communicating with said regenerator, c. two pumping chambers, each formed of a flexible metal bellows and disposed adjacent to and communicating with one of said heat exchangers, and d. means for driving said bellows to simultaneously expand one, and contract the other of said bellows alternately.

2. A heat pump as defined in claim 1, wherein the flexible metal bellows have welded edges, and the regenerator consists of a roll of corrugated metal foil material interleaved with smooth metal foil ribbon material to create interstices through which the working medium can pass.

3. A heat pump as defined in claim 2, comprising two regenerators of which one embraces the metal bellows.

4. A heat pump as defined in claim 1, comprising a pot-shaped displacer encased in a plastics sheath projecting into said metal bellows.

5. A heat pump as defined in claim 1, comprising a cross flow heat exchanger composed of elements consisting of two plates relatively spaced by projecting spacing ribs to form channels for the best transferring liquid, whereas the cross channels for the heat accepting air are formed by said elements being spaced apart by spacing strips interposed at right angles to said spacing webs separating the plates.

6. A heat pump as defined in claim 1 wherein said means for driving said bellows comprises a. a drive shaft having two pairs of cranks, b. two cross beams spaced from said drive shaft and connected to said bellows respectively, and c. a pair of spaced connecting rods extending from each pair of cranks to each of said cross beams.

7. A heat pump as defined in claim 6 wherein said pairs of cranks are arranged such that said two bellows expand and contract in a harmonic cycle with a relative displacement of about ninety degrees.

8. A heat pump as defined in claim 1 further comprising an annular regenerator surrounding one of said bellows, said regenerator comprising a roll of corrugated metal foil ribbon material interleaved with smooth metal foil ribbon material to create interstices through which the working medium can pass.

9. A heat pump which is operationally based on the Stirling cycle and which comprises:

a. a heat regenerator;

b. at least one heat exchanger for circulating a heat transferring liquid and disposed adjacent to and communicating with said regenerator;

c. at least one flexible metal bellows constituting a pumping chamber and disposed adjacent to and communicating with said heat exchanger;

d. a high pressure vessel completely enclosing at least said bellows; and e. a gas at a pressure above atmospheric pressure in said vessel to increase the thermal output of said heat pump.

10. A heat pump as defined in claim 9 comprising a pot-shaped displacer encased in a plastic sheath projecting into said metal bellows.

11. A heat pump as defined in claim 9 comprising a cross flow heat exchanger composed of elements consisting of two plates relatively spaced by projecting spacing ribs to form channels for the passage of het transferring liquid, said elements being spaced apart by spacing strips interposed at right angles to said spacing ribs to form cross channels for heat accepting gas.

12. A method of operating a heat pump which is operationally based on the Stirling cycle and includes a heat generator, at least one heat exchanger for circulating a heat transferring liquid and disposed adjacent and communicating with said regenerator, at least one flexible metal bellows constituting a pumping chamber and disposed adjacent to and communicating with said heat exchanger and a high pressure vessel completely enclosing at least said bellows, said method comprising maintaining a gas under pressure above atmospheric pressure in said vessel during operation of said heat pump to increase the thermal output of said heat pump.

* * * * *